US008235668B2

(12) United States Patent
Shirahama

(10) Patent No.: US 8,235,668 B2
(45) Date of Patent: Aug. 7, 2012

(54) MULTIBLADE AIR BLOWER

(75) Inventor: Seiji Shirahama, Aichi (JP)

(73) Assignee: Panasonic Corporation, Osaka (JP)

( * ) Notice: Subject to any disclaimer, the term of this patent is extended or adjusted under 35 U.S.C. 154(b) by 1089 days.

(21) Appl. No.: 12/096,278

(22) PCT Filed: Dec. 8, 2006

(86) PCT No.: PCT/JP2006/324507
§ 371 (c)(1),
(2), (4) Date: Jun. 5, 2008

(87) PCT Pub. No.: WO2007/069535
PCT Pub. Date: Jun. 21, 2007

(65) Prior Publication Data

US 2010/0215486 A1 Aug. 26, 2010

(30) Foreign Application Priority Data

Dec. 14, 2005 (JP) ..... 2005-359952

(51) Int. Cl.

| | |
|---|---|
| ***B63H 1/16*** | (2006.01) |
| ***B64C 11/00*** | (2006.01) |
| ***B64C 27/20*** | (2006.01) |
| ***F01D 5/22*** | (2006.01) |
| ***F04D 29/44*** | (2006.01) |

(52) U.S. Cl. ..... 416/187; 415/205

(58) Field of Classification Search ..... 416/183, 416/185, 186 R, 187, 223 B, 178
See application file for complete search history.

(56) References Cited

U.S. PATENT DOCUMENTS

| | | | | |
|---|---|---|---|---|
| 6,007,300 | A * | 12/1999 | Saeki et al. | 416/178 |
| 6,299,409 | B1 * | 10/2001 | Matsunaga et al. | 415/206 |
| 6,402,473 | B1 * | 6/2002 | Chapman | 416/178 |
| 6,964,555 | B2 * | 11/2005 | Ochiai et al. | 415/204 |
| 7,244,099 | B2 | 7/2007 | Yamasaki | |

(Continued)

FOREIGN PATENT DOCUMENTS

EP 1411247 A1 4/2004

(Continued)

OTHER PUBLICATIONS

Omori et al. (JP 2005-036732) foreign reference; Omori et al. (JP 2005-036732) abstract translation; Omori et al. (JP 2005-036732) translation.*

(Continued)

*Primary Examiner* — Nathaniel Wiehe
*Assistant Examiner* — Su Htay
(74) *Attorney, Agent, or Firm* — Pearne & Gordon LLP

(57) ABSTRACT

A multiblade air blower has a multiblade impeller, an orifice, an axially overlaid portion, and an airflow collision prevention device. The multiblade impeller includes a main plate and a blade. The blade is provided at the main plate to form a blade inner periphery. The orifice has an open end and an orifice inner periphery. The open end is positioned toward the main plate from a blade end face. The orifice inner periphery has an inner diameter larger than that of the blade inner periphery, and guides air to the multiblade impeller. The axially overlaid portion is a part where the orifice and the blades are overlaid. The airflow collision prevention device is provided at the blade and at an inner side of the orifice inner periphery. The multiblade air blower suppresses loss of air distribution efficiency and increased noise.

15 Claims, 8 Drawing Sheets

U.S. PATENT DOCUMENTS

2006/0140758 A1* 6/2006 Ochiai et al. ..... 415/206

FOREIGN PATENT DOCUMENTS

| | | | |
|---|---|---|---|
| JP | 57-157798 | U | 3/1956 |
| JP | 10-185238 | | 7/1998 |
| JP | 2000-291590 | | 10/2000 |
| JP | 2000-291590 | A | 10/2000 |
| JP | 2001-115997 | | 4/2001 |
| JP | 2001-115997 | A | 4/2001 |
| JP | 2002-161890 | | 6/2002 |
| JP | 2002-161890 | A | 6/2002 |
| JP | 2003-035293 | | 2/2003 |
| JP | 2003-35293 | A | 2/2003 |
| JP | 2004-353665 | A | 12/2004 |
| JP | 2005036732 | A * | 2/2005 |

OTHER PUBLICATIONS

Chinese Office action.
International Search Report Dated Jan. 9, 2007.
Japanese Office action for JP2005-359952 dated Dec. 28, 2010.

* cited by examiner

MULTIBLADE AIR BLOWER

This application is a U.S. national phase application of PCT international application PCT/JP2006/324507, filed Dec. 8, 2006.

TECHNICAL FIELD

The present invention relates to multiblade air blowers of typically the type employed in ventilation fans installed in ceilings.

BACKGROUND ART

Conventional multiblade air blowers of this type have a structure in which the blade ends and orifice are axially overlaid. (Refer to Patent Document 1.)

The conventional multiblade air blower disclosed in Patent Document 1 is described below with reference to FIGS. 8A and 8B.

As shown in FIGS. 8A and 8B, multiblade air blower 101 includes multiblade fan 105 (hereafter referred to as "fan 105"), scroll casing 107, and orifice 110. Fan 105 includes round end plate 102 and a plurality of multiple blades 104. One end of each of blades 104 is fixed to one face periphery 103 of round end plate 102. The other ends of blades 104 are connected at their outer periphery. Scroll casing 107 houses fan 105, and guides air taken in from front inlet 106 of fan 105 in a centrifugal direction. One corner of inner periphery 108 of the other end of each blade 104 is notched so that tips 109 of blades 104 are overlaid on orifice 110. Orifice 110 configures front inlet 106.

In the above structure, blade inner diameter Db 1 and orifice inner diameter Do1 have the same dimensions, and multiblade air blower 101 has blades 104 that are long in the direction of rotational axis.

Next, another conventional multiblade air blower is disclosed (Refer to Patent Document 2.) The conventional multiblade air blower disclosed in Patent Document 2 is described below with reference to FIG. 9. As shown in FIG. 9, multiblade air blower 201 includes multiblade fan 205, fan motor 213, and scroll casing 207. Fan 205 has multiple blades 204. Fan 205 is fixed to motor shaft 212 of fan motor 213. Fan 205 is housed inside of scroll casing 207, and spiral scroll chamber 214 is formed around the outer periphery of fan 205.

In addition, scroll casing 207 includes intake side case plate 216 and motor side case plate 217. Intake side case plate 216 has air inlet 215. Motor side case plate 217 is positioned at the opposite side of intake side case plate 216 with fan 205 in between. A motor body of fan motor 213 is fixed to motor side case plate 217. Backflow suppression device 218 is provided at an outside of fan diameter Df2. Backflow suppression device 218 suppresses backflow of air in scroll chamber 214 to flow back from scroll chamber 214 to air inlet 215 via an intake space between fan 205 and intake side case plate 216.

This structure suppresses the backflow of air to air inlet 215 from scroll chamber 214 via space 220 between blades 204 and orifice 210. In addition, since blade inner diameter Db2 is smaller than orifice diameter Do2, airflow to tips 209 of blades 204 is enhanced.

Patent Document 1: Japanese Patent Unexamined Publication No. H10-185238

Patent Document 2: Japanese Patent Unexamined Publication No. 2002-161890 20

SUMMARY OF THE INVENTION

The present invention offers a multiblade air blower that suppresses backflow from a scroll chamber to air intake space of a multiblade impeller and disturbance of airflow at a blade end face. The present invention can thus offer the multiblade air blower that suppresses loss of air distribution efficiency and increased noise.

The multiblade air blower of the present invention includes the multiblade impeller, a casing, an orifice, an axially overlaid portion, and an airflow collision prevention device. The multiblade impeller includes a main plate and blades. The blade has a blade end face, and is provided at the main plate to form a blade inner periphery. The casing houses the multiblade impeller. The orifice includes an open end and an orifice inner periphery. The open end is positioned toward the main plate from the blade end face. The orifice inner periphery has an inner diameter larger than that of the blade inner periphery, and guides air to the multiblade impeller. The axially overlaid portion is a part where the orifice and the blades are overlaid. The blade has the airflow collision prevention device at an inner side of the orifice inner periphery. This structure suppresses backflow of air and airflow disturbance at high air volume. Accordingly, the multiblade air blower that suppresses loss of air distribution efficiency and increased noise is obtained.

REFERENCE MARKS IN THE DRAWINGS

Figure 1A:
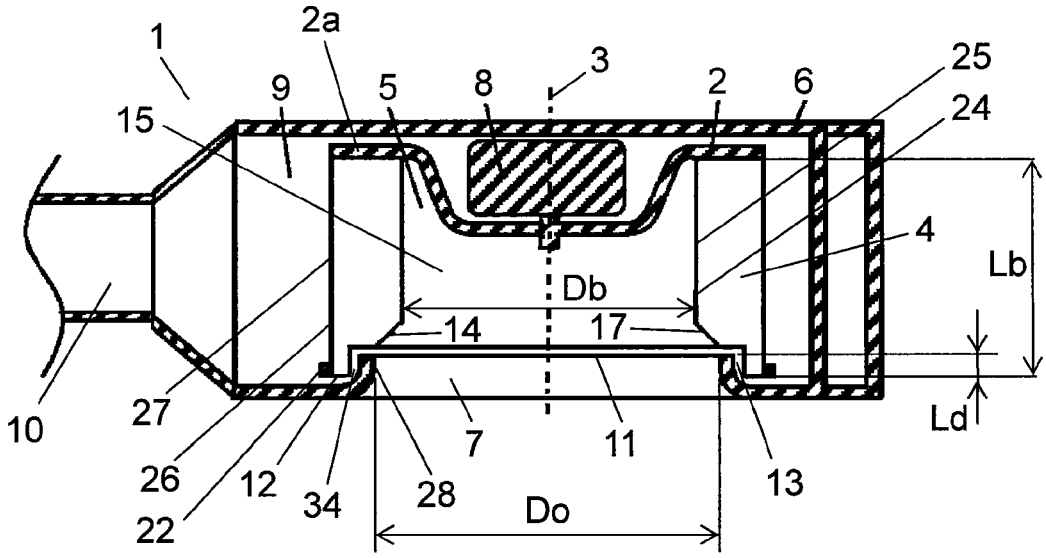
FIG. 1A is a side sectional view illustrating a multiblade air blower in accordance with a first exemplary embodiment of the present invention.

1 Multiblade air blower
2 Main plate
3 Rotational axis
4 Blade
5 Multiblade impeller
6 Casing

7 Orifice
8 Motor
9 Scroll chamber
10 Duct
11 Open end
12 Blade end face
13 Axially overlaid portion
14 Airflow collision prevention device
15 Intake space
16 Tongue portion
17 Notched portion
18 Forward-tilted portion
19 Draft portion
20 Curved portion
25 Blade inner periphery
28 Orifice inner periphery
32 Blade end outer periphery
33 Orifice outer periphery
34 Clearance

DETAILED DESCRIPTION OF PREFERRED EMBODIMENTS

Exemplary embodiments of the present invention are described below with reference to drawings.

First Exemplary Embodiment

Figure 1B:
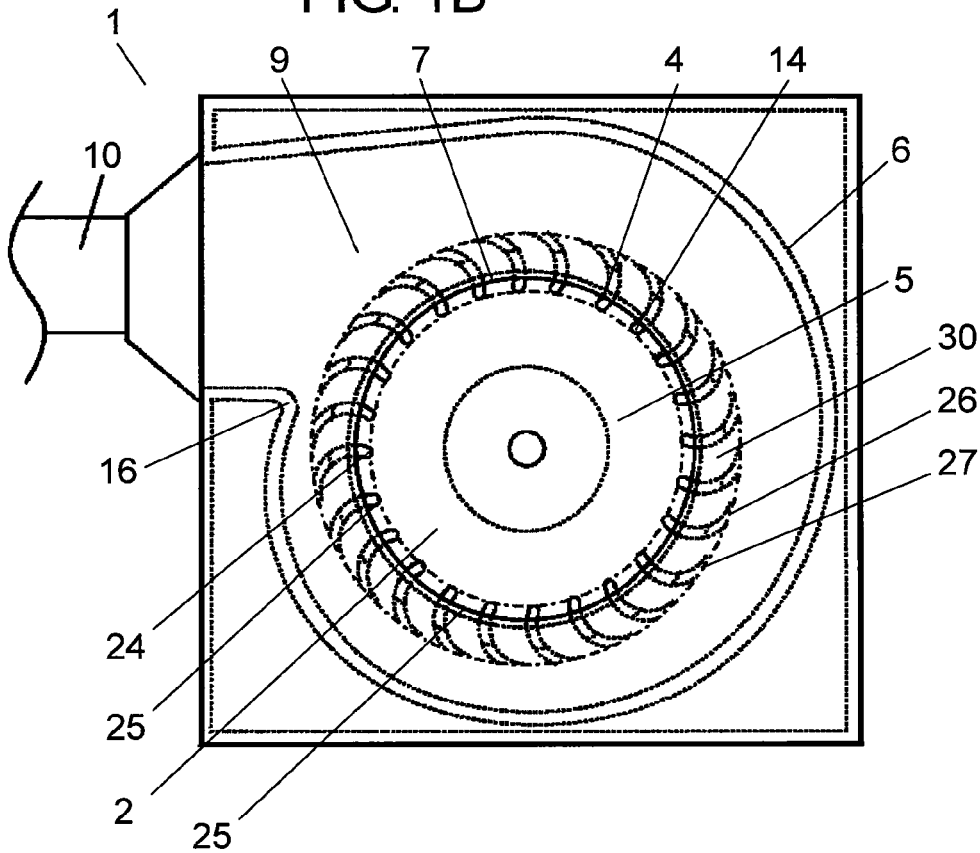
FIG. 1B is a front view of the multiblade air blower shown in FIG. 1A.

FIGS. 1A and 1B show a multiblade air blower in the first exemplary embodiment of the present invention.

As shown in FIGS. 1A and 1B, multiblade air blower 1 (hereafter referred to as "air blower 1") includes multiblade impeller 5 (hereafter referred to as "impeller 5"), casing 6, and orifice 7. Impeller 5 includes disc-shaped main plate 2 and a plurality of blades 4. One end of blade 4 is connected to outer periphery 2*a* of main plate 2, multiple blades 4 are disposed with space 30, which has a predetermined distance, in between. The other ends of blades 4 are connected and fixed to annular outer frame 22. The cross-sectional shape of each of blades 4 vertical to rotational axis 3, about which impeller 5 rotates, is a substantially circular arc. Blade inner periphery 25 is configured with inner peripheral end 24 of each blade 4 provided at outer periphery 2*a* of main plate 2. Blade outer periphery 27 is configured with outer peripheral end 26 of each blade 4. Impeller 5 is typically 180 mm in outer diameter, and 70 mm in height.

In other words, the outer diameter of impeller 5 is the outer diameter of blade outer periphery 27. Casing 6 houses impeller 5, and is a spiral-shaped scroll casing. Orifice 7 guides air passing an inner face of orifice inner periphery 28 to impeller 5. Impeller 5 rotates by transmitting the drive force of electric motor 8, which is connected to impeller 5, to impeller 5. By the rotation of impeller 5, air led to impeller 5 through orifice 7 is fed to scroll chamber 9 via each space 30. The air fed to scroll chamber 9 is discharged to outside of air blower 1 through duct 10 connected to scroll chamber 9.

In air blower 1 shown in FIG. 1B, the cross-sectional shape of blade 4 vertical to rotational axis 3 is a circular arc of radius 14 mm and 1.5 mm in thickness. However, it is apparent that the cross-sectional shape of blade 4 is not limited to the shape shown in FIG. 1B as long as it is a shape that can smoothly change the direction of air flowing into spaces 30 from inner peripheral end 24 of blade 4 to outer peripheral ends 26 of blade 4. For example, blade 4 may have a cross-sectional shape of multiple circular arcs (not illustrated) or an air wheel shape (not illustrated) whose thickness changes from inner peripheral end 24 to outer peripheral end 26.

Orifice inner diameter Do, which is an inner diameter of orifice inner periphery 28, is 170 mm. Blade inner diameter Db, which is an inner diameter of blade inner periphery 25, is 160 mm. Orifice inner diameter Do is thus larger than blade inner diameter Db. In addition, open end 11 of orifice 7 is recessed for 5 mm toward main plate 2 from the level of blade end face 12. This forms axially overlaid portion 13 where orifice 7 and blades 4 are overlaid in the direction of rotational axis 3. Airflow collision prevention device 14 is also provided at orifice 7 side of blade 4. Airflow collision prevention device 14 is provided at an inner side of orifice inner periphery 28. In other words, airflow collision prevention device 14 is provided at a part toward rotational axis 3 from orifice inner periphery 28. Airflow collision prevention device 14 shown in FIG. 1A is configured with notched portion 17 in which a corner of each of blades 4 is notched.

A general characteristic of multiblade air blower 1 is that the main airflow arriving at impeller 5 at high air volume is formed at the side of main plate 2 with respect to the direction of rotational axis 3. Accordingly, airflow in the centrifugal direction is small at orifice 7 side of blades 4.

However, multiblade air blower 1 has airflow collision prevention device 14. Airflow collision prevention device 14 enables air, which is guided by orifice 7 in the direction of rotational axis 3 relative to blade end face 12, to flow to space 30 without being disturbed by corners of blades 4. This results in suppression of noise generated by the disturbance of airflow. At the same time, airflow in the centrifugal direction is also generated at orifice 7 side of blades 4 with respect to rotational axis 3. This achieves multiblade air blower 1 that suppresses noise generation and shows high air distribution efficiency.

In addition, multiblade air blower 1 has axially overlaid portion 13. This suppresses backflow of the air fed from blades 4 to scroll chamber 9 to intake space 15 of impeller 5 again through space 30 or clearance 34 between blades 4 and orifice 7. Accordingly, loss of air distribution efficiency and large noise generation are suppressed. This also eliminates the need for a complicated backflow prevention structure, such as by providing a longer distance between tongue portion 16 and blade outer periphery 27. A shorter distance is thus allowed between tongue portion 16 and blade outer periphery 27, leading to further suppression of loss of air distribution efficiency.

Furthermore, airflow collision prevention device 14 is configured with notched portion 17, as shown in FIG. 1A. If notched portion 17 is too large, the air distribution efficiency decreases due to insufficient area of blades 4 that effect air distribution. On the other hand, if notched portion 17 is too small, airflow collision prevention device 14 will not function effectively. In the light of these facts, notched portion 17 is formed by notching each blade 4 for 5 mm in the direction of rotational axis 3 and 5 mm in the radial direction of impeller 5.

Airflow collision prevention device 14 is thus simply configured by means of notched portion 17 to suppress any increased noise or loss of air distribution efficiency in multiblade air blower 1. At the same time, multiblade air blower 1 is achievable at low cost due to the simple structure of airflow collision prevention device 14.

In the above description, notched portion 17 has a shape 5 mm in the axial direction and 5 mm in the radial direction. However, the shape of notched portion 17 is not limited to this shape. The shape of notched portion 17 can be determined based on the balance between the air distribution efficiency and the airflow collision preventing function.

Axially overlaid portion 13 has the function of suppressing backflow of the air, which is fed to scroll chamber 9 from intake space 15 via space 30, to intake space 15 again via clearance 34. Accordingly, if a percentage of length Ld of axially overlaid portion 13 in length Lb of blade 4 in the axial direction is too large, effective length L=Lb−Ld of blades 4 that generate the main airflow distributed by impeller 5 is shortened. In other words, the air distribution efficiency of impeller 5 decreases if effective length L of blades 4 is short. On the other hand, if the percentage of length Ld in length Lb is too small, the function of suppressing backflow from scroll chamber 9 to intake space 15 does not work effectively. In the light of these facts, axial length Ld of axially overlaid portion 13 is set to 5 mm.

In the above description, axial length Ld of axially overlaid portion 13 is 5 mm. However, axial length Ld of axially overlaid portion 13 is not limited to 5 mm. The axial length Ld of the axially overlaid portion 13 can be determined based on the balance between the air distribution efficiency and the backflow suppressing function.

Second Exemplary Embodiment

Figure 2:
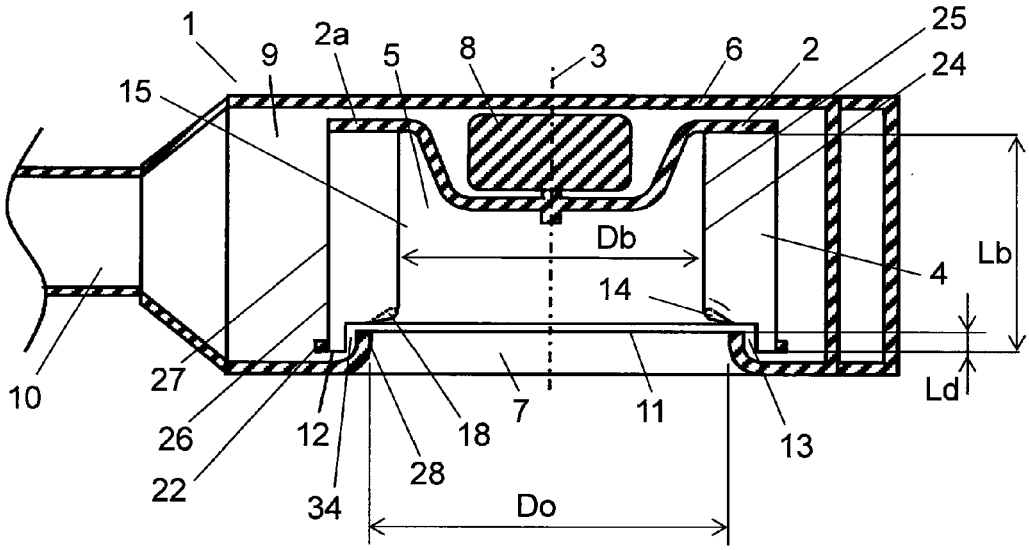
FIG. 2 is a side sectional view of a multiblade air blower in accordance with a second exemplary embodiment of the present invention.
Figure 3:
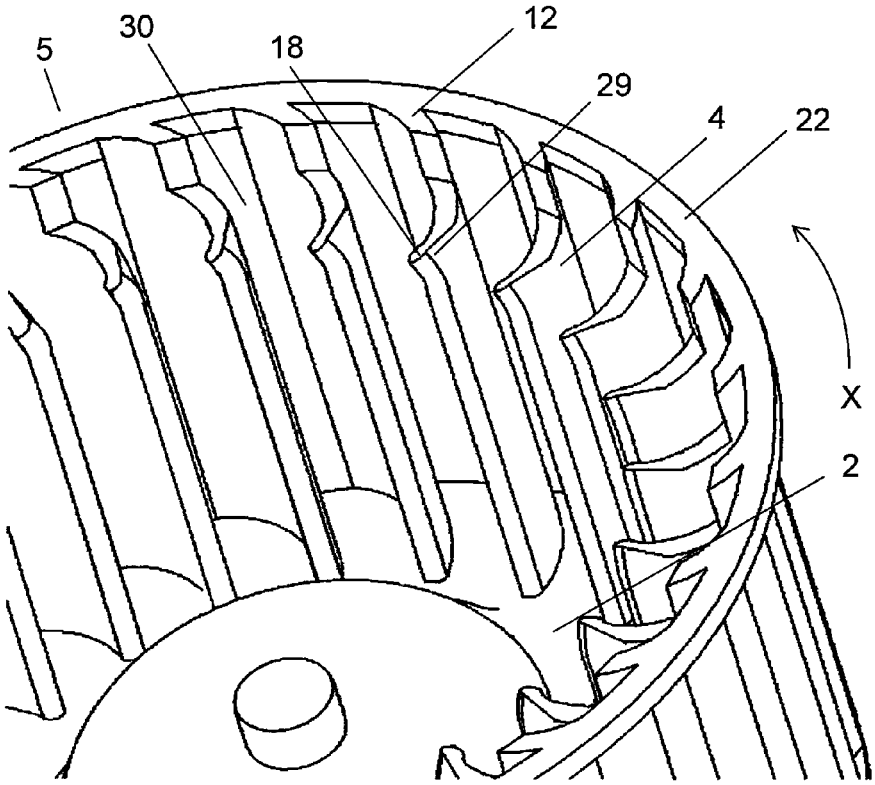
FIG. 3 is a fragmentary perspective view of a multiblade impeller employed in the multiblade air blower show in FIG. 2.

FIGS. 2 and 3 show a multiblade air blower in a second exemplary embodiment of the present invention. The same components as those in the first exemplary embodiment are given the same reference marks to omit their detailed descriptions.

Airflow collision prevention device 14, shown in FIGS. 2 and 3, is provided at blade end face 12 side of blade 4, as in the first exemplary embodiment. Airflow collision prevention device 14 in the second exemplary embodiment is configured with forward-tilted portion 18 that is tilted forward in the direction of rotation (direction of arrow x) of impeller 5 at corner 29 of each blade 4 and at the inner side of orifice inner periphery 28. If forward-tilted portion 18 is too large, or the tilting angle is too large, the air distribution efficiency of multiblade air blower 1 decreases due to inhibition of air entering blades 4. If forward-tilted portion 18 or the tilting angle is too small, forward-tilted portion 18 cannot function effectively as airflow collision prevention device 14. In the light of these facts, forward-tilted portion 18 has an area of 5 mm in the direction of rotational axis 3 and 5 mm in the radial direction of impeller 5, and is tilted forward at an angle of 30° in the direction of rotation.

Airflow collision prevention device 14 is thus simply configured by means of forward-tilted portion 18 to prevent collision of airflow and suppress loss of air distribution efficiency, while suppressing any increased noise. In addition, forward-tilted portion 18 guides airflow to space 30. This improves the air distribution efficiency of multiblade air blower 1.

In the above description, forward-tilted portion 18 has a shape 5 mm in the direction of rotational axis 3 and 5 mm in the radial direction of impeller 5, and is tilted forward at an angle of 30° in the direction of rotation. However, the shape of forward-tilted portion 18 is not limited to this shepe. The shape of forward-tilted portion 18 can be determined based on the balance between the air distribution efficiency and the airflow collision preventing function.

Third Exemplary Embodiment

Figure 4A:
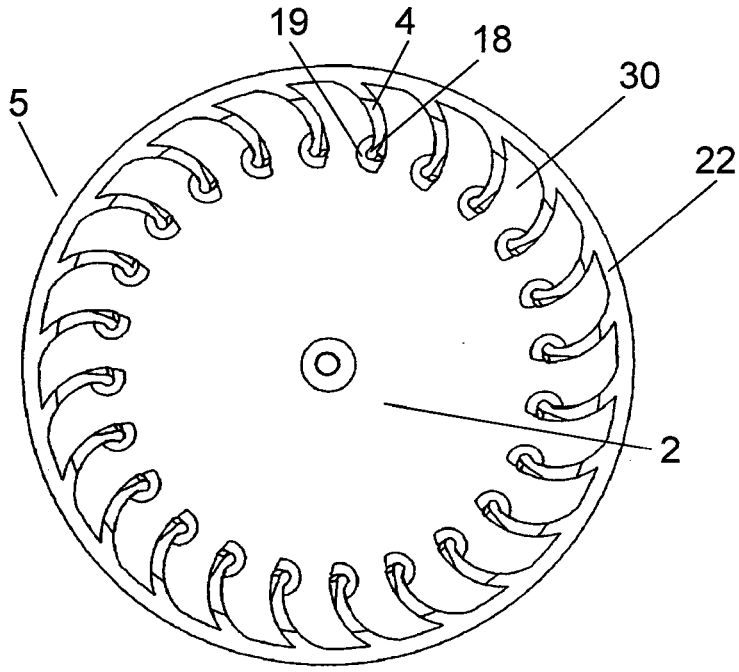
FIG. 4A is a front view of a multiblade impeller employed in a multiblade air blower in accordance with a third exemplary embodiment of the present invention.
Figure 4B:
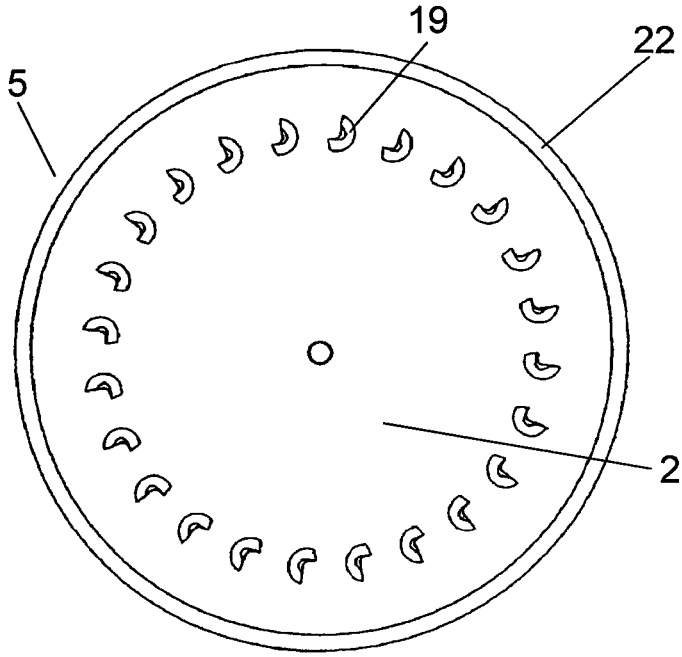
FIG. 4B is a rear view of the multiblade impeller shown in FIG. 4A.
Figure 4C:
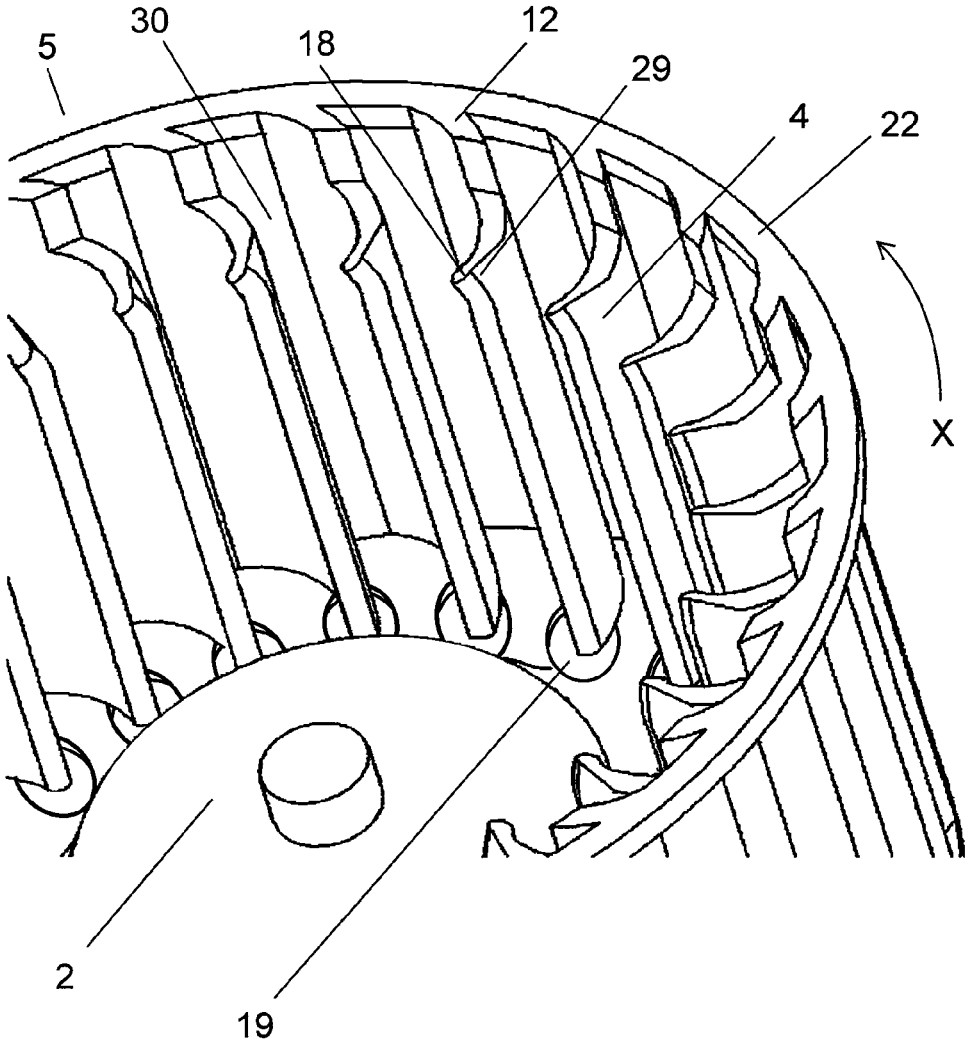
FIG. 4C is a fragmentary perspective view of the multiblade impeller shown in FIG. 4A

FIGS. 4A, 4B, and 4C show a multiblade impeller employed in a multiblade air blower in the third exemplary embodiment of the present invention. The same components as those in the first and second exemplary embodiments are given the same reference marks to omit their detailed descriptions.

As shown in FIGS. 4A, 4B, and 4C, draft portion 19 that has a hole is provided at a part of main plate 2 where forward-tilted portion 18 is projected on main plate 2. The direction of forward-tilted portion 18 projected on main plate 2 is the direction of rotational axis 3. By providing draft portion 19 at multiblade impeller 5, impeller 5 can be molded using molds that only move in the direction of rotational axis 3 when impeller 5 is manufactured using resin molding. More specifically, since forward-tilted portion 18 extends like a window roof, the mold for forming this forward-tilted portion 18 can be released through this draft portion 19 when impeller 5 is molded. This enables molding of impeller 5 by using molds that move only in the direction of rotational axis 3. Accordingly, impeller 5 can be easily manufactured at low cost. Impeller 5 shown in FIGS. 4A, 4B, and 4C includes draft portion 19 that has an outline 3 mm larger than the area of forward-tilted portion 18 projected on main plate 2. This is designed for ease of machining of molds for manufacturing impeller 5 and ease of injection molding of impeller 5.

In the above description, draft portion 19 has the outline 3 mm larger than the area of forward-tilted portion 18 projected on main plate 2. However, the shape of draft portion 19 is not limited to this shape. The shape of draft portion 19 can be determined based on ease of machining molds for manufacturing impeller 5, ease of injection molding of impeller 5, and also mechanical strength of impeller 5.

Fourth Exemplary Embodiment

Figure 5:
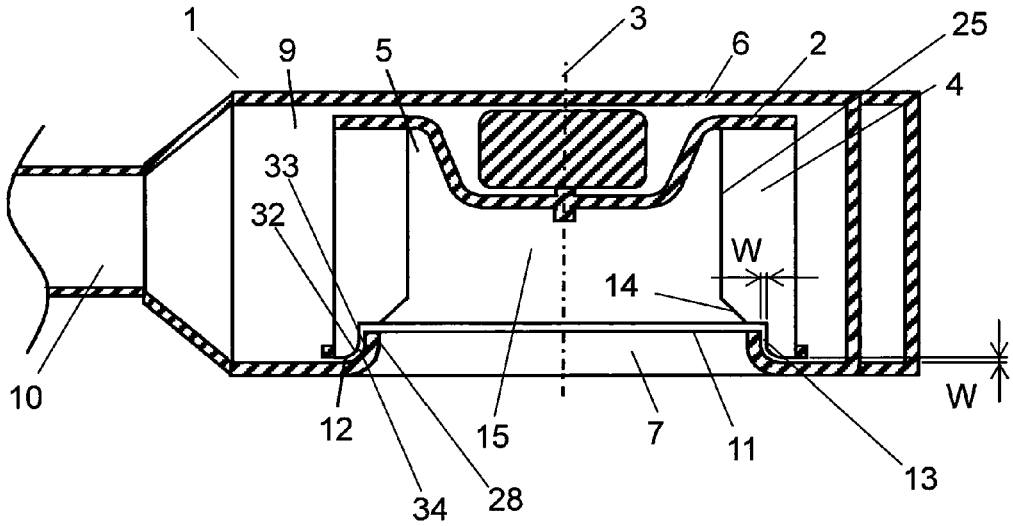
FIG. 5 is a side sectional view of a multiblade air blower in accordance with a fourth exemplary embodiment of the present invention.

FIG. 5 is a multiblade air blower in the fourth exemplary embodiment of the present invention. The same components as those in the first to third exemplary embodiments are given the same reference marks to omit their detailed descriptions.

As shown in FIG. 5, multiblade air blower 1 has predetermined clearance 34 between blade end outer periphery 32 and orifice outer periphery 33 that is the outer peripheral face of orifice 7. Clearance 34 has a substantially constant distance W. More specifically, blade 4 and orifice 7 are close to each other with the substantially constant distance of clearance 34.

In multiblade air blower 1 shown in FIG. 5, distance W between blade end outer periphery 32 and orifice outer periphery 33 is 3 mm. The dimension of distance W of clearance 34 is determined such that the balance of rotation of impeller 5 does not become uneven due to adhesion of dust and other matter to clearance 34 when multiblade air blower 1 is used as a ventilating fan. In addition, the dimension of distance W of clearance 34 is determined such that impeller 5 does not contact orifice 7 or tongue portion 16 during rotation.

With the above structure, the total extended distance of the closest portion of blade end outer periphery 32 and orifice outer periphery 33 becomes long. This suppresses backflow of air from scroll chamber 9 to intake space 15 through clearance 34 between blades 4 and orifice 7. Consequently, loss of air distribution efficiency of multiblade air blower 1 can be suppressed.

In the above description, distance W of clearance 34 is 3 mm. However, clearance 34 is not limited to 3 mm. The dimension of distance W of clearance 34 can be determined based on elements including the airflow collision preventing function, the balance of impeller 5 affected by adhesion of dust, and prevention of contact of impeller 5 with other surrounding members.

Fifth Exemplary Embodiment

Figure 6:
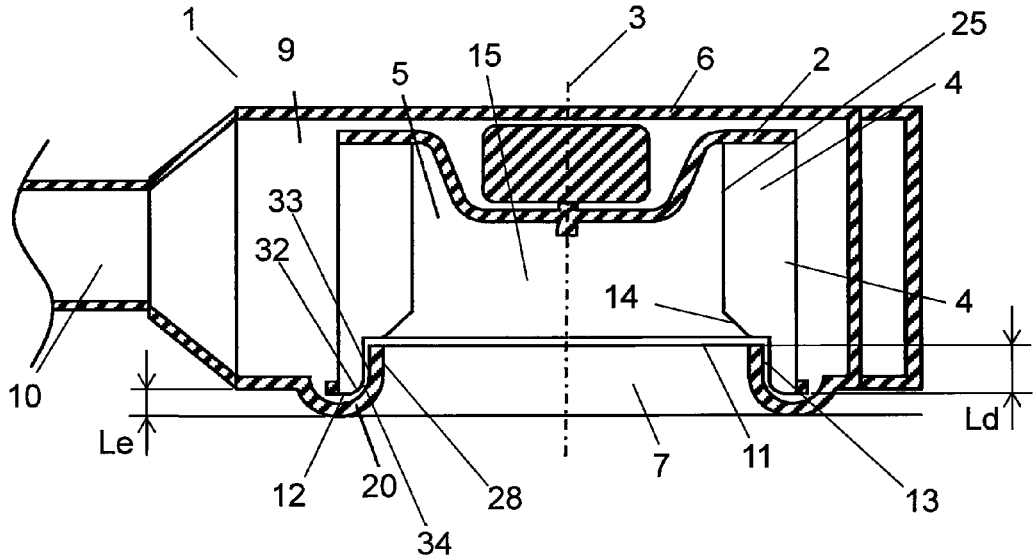
FIG. 6 is a side sectional view of a multiblade air blower in accordance with a fifth exemplary embodiment of the present invention.

FIG. 6 is a multiblade air blower in the fifth exemplary embodiment of the present invention. The same components as those in the first to fourth exemplary embodiments are given the same reference marks to omit their detailed descriptions.

Multiblade air blower 1 shown in FIG. 6 includes curved portion 20. Curved portion 20 is provided at orifice 7, and is protruding in a direction opposite to multiblade impeller 5. In addition, blade end outer periphery 32 is positioned inside curved portion 20. An inner face of curved portion 20 configure orifice outer periphery 33. In multiblade air blower 1 shown in FIG. 6, curved portion 20 protrudes in the direction of rotational axis 3 for a dimension of protrusion Le=7 mm.

The above structure makes length Ld of axially overlaid portion 13 of orifice 7 and blade 4 further longer in the axial direction. This further suppresses backflow of air from scroll chamber 9 to intake space 15 via clearance 34 between blades 4 and orifice 7. Accordingly, loss of air distribution efficiency can be further suppressed.

In the above description, the dimension of protrusion Le of curved portion 20 is 7 mm. However, the dimension of protrusion Le of curved portion 20 is not limited to 7 mm. The dimension of protrusion Le of curved portion 20 can be determined based on the balance between the air distribution efficiency and the airflow collision preventing function. In addition, the dimension of protrusion Le can be determined based on other elements such as an outer shape of multiblade air blower 1.

In the fifth exemplary embodiment, blade 4 and orifice 7 may be close to each other with substantially constant distance W of clearance 34, as described in the fourth exemplary embodiment. If clearance 34 has substantially constant distance W, the total extended distance of the closest portion of blade end outer periphery 32 and orifice outer periphery 33 becomes further longer. This further increases the effect of suppressing backflow of air.

Sixth Exemplary Embodiment

Figure 7:
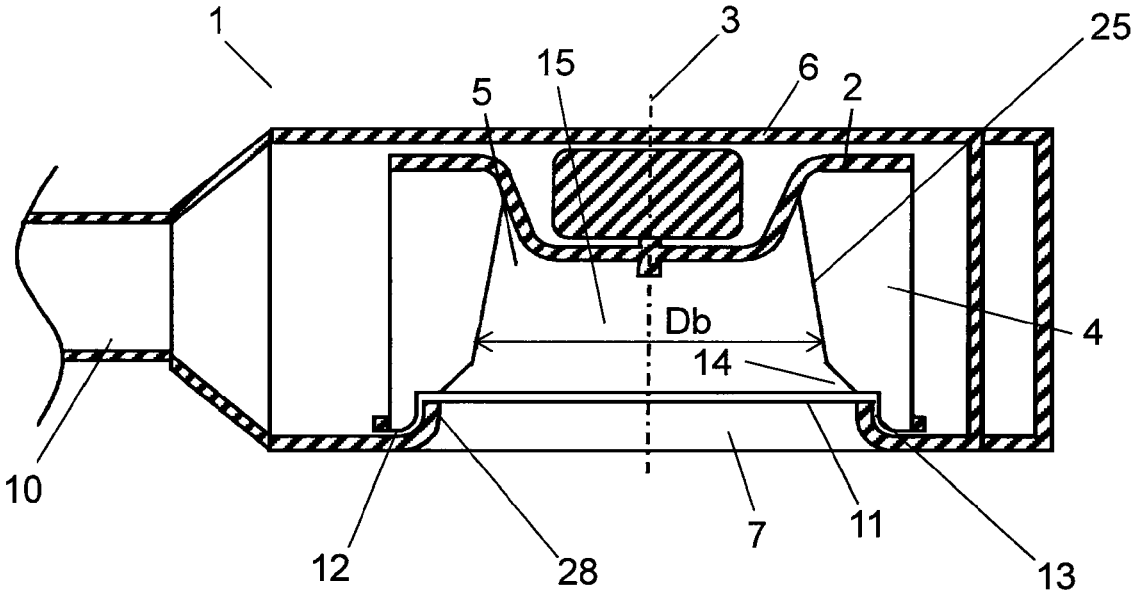
FIG. 7 is a side sectional view of a multiblade air blower in accordance with a six exemplary embodiment of the present invention.
Figure 8A:
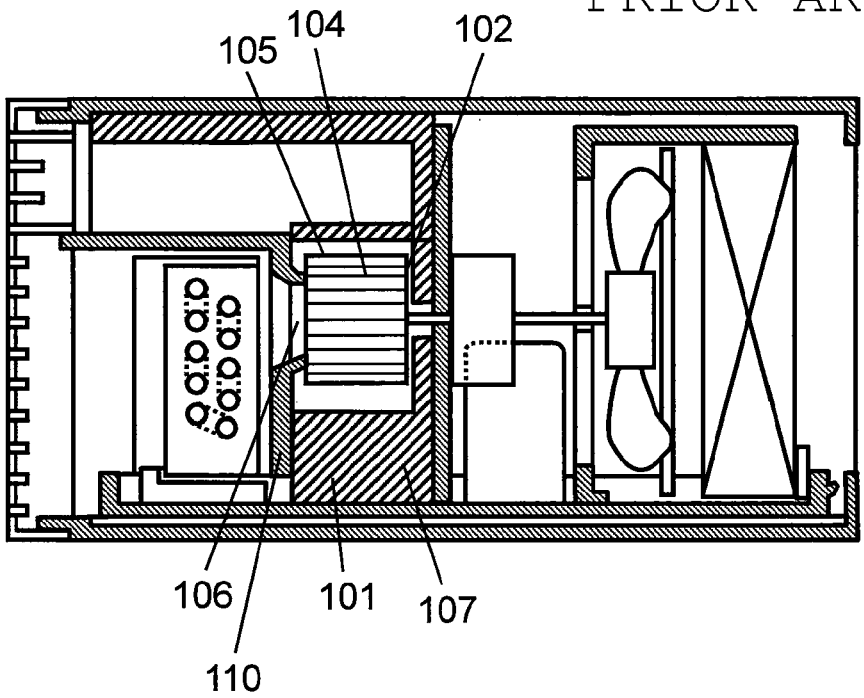
FIG. 8A PRIOR ART
FIG. 8A is a side sectional view of a conventional multiblade air blower.
Figure 8B:
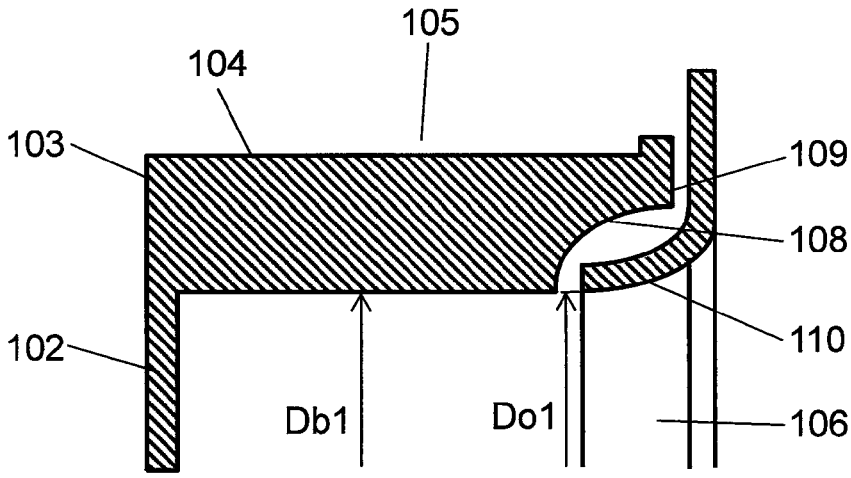
FIG. 8B PRIOR ART
FIG. 8B is a fragmentary side sectional view of the multiblade air blower shown in FIG. 8A.
Figure 9:
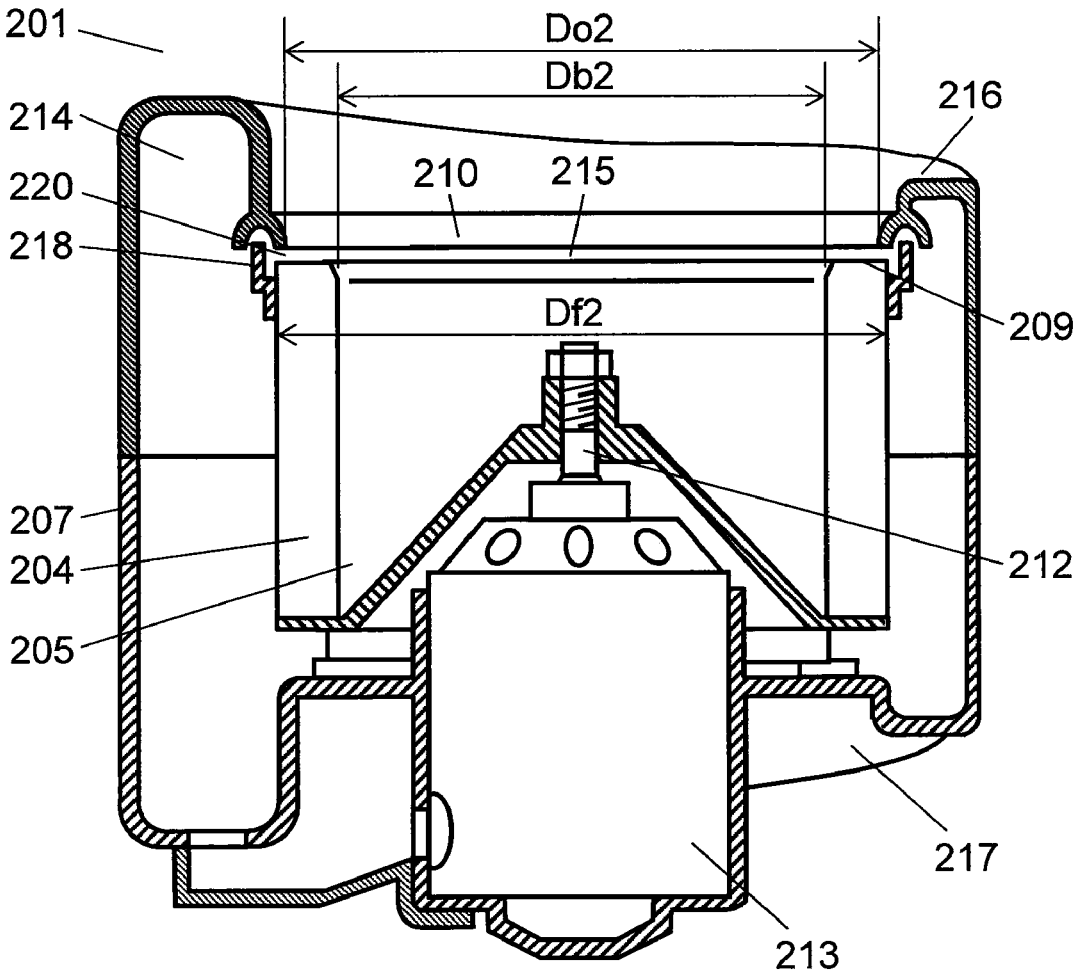
FIG. 9 PRIOR ART
FIG. 9 is a side sectional view of a conventional multiblade air blower.

FIG. 7 is a multiblade air blower in the sixth exemplary embodiment of the present invention. The same components as those in the first to fifth exemplary embodiments are given the same reference marks to omit their detailed descriptions.

As shown in FIG. 7, blade inner periphery 25 gradually becomes smaller toward main plate 2, and thus blade inner periphery 25 is tilted in multiblade air blower 1. Blade inner diameter Db at a side of main plate 2 is 150 mm, in multiblade air blower 1 shown in FIG. 7. Blade inner diameter Db at a side of orifice 7 is 160 mm.

In general, the main airflow is formed at the side of orifice 7 in the direction of rotational axis 3 of impeller 5 when air volume is low. However, the above structure enhances air to flow to the side of main plate 2 in the direction of rotational axis 3. This improves the air distribution efficiency of multiblade air blower 1.

In the above description, blade inner diameter Db at the side of main plate 2 is 150 mm. However, blade inner diameter Db at the side of main plate 2 is not limited to 150 mm. Blade inner diameter Db at the side of main plate 2 can be determined based characteristics of the multiblade air blower such as the air distribution efficiency and noise.

In the sixth exemplary embodiment, blade 4 and orifice 7 may be made close to each other with substantially constant distance W of clearance 34, as described in the fourth exemplary embodiment. In addition, orifice 7 may have curved portion 20 described in the fifth exemplary embodiment. By adding the structures described in the fourth and fifth exemplary embodiments to multiblade air blower 1 in the sixth exemplary embodiment, the present invention can offer multiblade air blower 1 with further improved characteristics including the air distribution efficiency.

INDUSTRIAL APPLICABILITY

The present invention suppresses backflow of air from a scroll chamber to a blade inner periphery via a space between blades or a space between the blades and an orifice, and also suppresses airflow disturbance at end faces of the blades. Accordingly, the present invention offers a multiblade air blower characterized by suppression of loss of air distribution efficiency and increased noise, which can be manufactured at low cost.

The invention claimed is:

1. A multiblade air blower comprising:

a multiblade impeller including a main plate and a plurality of blades, each of which has a blade end face, being provided at the main plate and forming a blade inner periphery;

a casing housing the multiblade impeller;

an orifice including:

an open end positioned toward the main plate from the blade end face; and an orifice inner periphery having an inner diameter larger than that of the blade inner periphery, the orifice inner periphery guiding air to the multiblade impeller; and an axially overlaid portion where the orifice and the plurality of blades are overlaid; and the impeller further including an airflow collision prevention device provided at each of the plurality of blades, and the airflow collision prevention device is provided at an inner side of the orifice inner periphery, wherein the airflow collision prevention device is a forward-tilted portion provided at a corner of the blade end face and an inner peripheral end of each of the plurality of blades, and wherein the forward-tilted portion provided at the corner is tilted forward from another portion of the inner peripheral end.

2. The multiblade air blower of claim 1, wherein the airflow collision prevention device is provided at a side of the blade end face of each of the plurality of blades, the forward-tilted portion being tilted forward in a direction of rotation of the multiblade impeller.

3. The multiblade air blower of claim 2, wherein the main plate has a draft portion on an area where the forward-tilted portion is projected.

4. The multiblade air blower of claim 3, wherein each of the plurality of blades has a blade end outer periphery, and a clearance of a constant distance is provided between the blade end outer periphery and the orifice.

5. The multiblade air blower of claim 3, wherein each of the plurality of blades has a blade end outer periphery, and the orifice has a curved portion protruding in a direction opposite to the multiblade impeller, the blade end outer periphery being positioned in the curved portion.

6. The multiblade air blower of claim 3, wherein the blade inner periphery becomes gradually smaller toward the main plate.

7. The multiblade air blower of claim 3, wherein a cross-sectional shape of each of the plurality of blades vertical to an axis of rotation, about which the multiblade impeller rotates, is a circular arc.

8. The multiblade air blower of claim 2, wherein each of the plurality of blades has a blade end outer periphery, and a clearance of a constant distance is provided between the blade end outer periphery and the orifice.

9. The multiblade air blower of claim 2, wherein each of the plurality of blades has a blade end outer periphery, and the orifice has a curved portion protruding in a direction opposite to the multiblade impeller, the blade end outer periphery being positioned in the curved portion.

10. The multiblade air blower of claim 2, wherein the blade inner periphery becomes gradually smaller toward the main plate.

11. The multiblade air blower of claim 2, wherein a cross-sectional shape of each of the plurality of blades vertical to an axis of rotation, about which the multiblade impeller rotates, is a circular arc.

12. The multiblade air blower of claim 1, wherein each of the plurality of blades has a blade end outer periphery, and a clearance of a constant distance is provided between the blade end outer periphery and the orifice.

13. The multiblade air blower of claim 1, wherein each of the plurality of blades has a blade end outer periphery, and the orifice has a curved portion protruding in a direction opposite to the multiblade impeller, the blade end outer periphery being positioned in the curved portion.

14. The multiblade air blower of claim 1, wherein the blade inner periphery becomes gradually smaller toward the main plate.

15. The multiblade air blower of claim 1, wherein a cross-sectional shape of each of the plurality of blades vertical to an axis of rotation, about which the multiblade impeller rotates, is a circular arc.

* * * * *